US005911309A

United States Patent [19]

Penney

[11] Patent Number: 5,911,309

[45] Date of Patent: Jun. 15, 1999

[54] APPARATUS FOR PROTECTING A WORKER'S HAND

[76] Inventor: Barry Penney, Box 849, Nanton, Canada, T01-IRO

[21] Appl. No.: 08/898,912

[22] Filed: Jul. 23, 1997

[51] Int. Cl.[6] ..... A41D 19/00

[52] U.S. Cl. ..... 2/16; 2/159

[58] Field of Search ..... 2/16, 20, 21, 159, 2/160, 161.6

[56] References Cited

U.S. PATENT DOCUMENTS 1,259,507 3/1918 Gall ..... 2/16
2,394,136 2/1946 Bakke ..... 2/16
2,448,697 9/1948 Bakke ..... 2/16
4,272,849 6/1981 Thurston et al. ..... 2/16

*Primary Examiner*—Michael A. Neas
*Attorney, Agent, or Firm*—David S. Thompson

[57] ABSTRACT

An apparatus for protecting a worker's hand and wrist, particularly from the power saws is used in a meat cutting or lumber cutting environment. The apparatus provides a generally planar armor plate covering the back of the wrist, hand and fingers. An insulating layer covers the lower surface of the armor plate. The armor plate is segmented into hingably related wrist, hand and finger plates. The finger plate may be compound, with separately hinged index finger and outer finger plates. A glove, worn by the user, is connected to the armor plate by a plurality of adjustable straps.

1 Claim, 4 Drawing Sheets

APPARATUS FOR PROTECTING A WORKER'S HAND

CROSS-REFERENCES

There are no applications related to this application filed in this or any foreign country.

BACKGROUND

The meat cutting and forest products industries have a high incidence of hand injuries due to the use of various types of power saws. Repetitive movements over long periods of time tend to promote fatigue and behavior which results in injury. The speed at which work must be accomplished, typically to keep up with an assembly line, also puts workers at risk. Additionally, particularly within the meat cutting industry, cold temperatures tend to reduce manual dexterity and increase the number of injuries.

Safety equipment has resulted in some protection for workers, but has generally fallen short of what is needed. One type of known hand-protecting apparatus is the wire mesh glove. Such a glove incorporates the strength of steel with the flexibility of mesh to give significant protection against injury, particularly from knife blades. However, saw blades tends to grab the mesh and compound the injury; as a result use of such gloves is typically not recommended for use by workers using saws.

As a result, there is a significant unsatisfied need for a protecting apparatus that is suitable for use in protecting workers' hands from a variety of power equipment, including power saws in particular.

SUMMARY

The present invention is directed to an apparatus that satisfies the above needs. A novel apparatus for protecting a worker's hand 50 is provided that provides some or all of the following structures.

A generally planar armor plate 100, typically includes hingably related wrist, hand and finger plates. The wrist plate 130 typically includes a singular plate body 132 carrying an inner flange 136 and an outer flange 138. The plate body also typically defines fastener attachment slots 134, where a fastening strap 600 used to encircle the user's wrist may be attached.

In a preferred embodiment, a hand plate 160 is formed of a plurality of segments 162, 164, 166, which are themselves hingably related. The segments typically provide downwardly directed inner and outer flanges 172, 174. Slight variation in the width of the segments staggers the flanges so that relative movement of the segments does not cause the flanges to touch each other. The middle segment typically defines fastener attachment slots 170, where a fastening strap 650 used to encircle the user's hand may be attached.

A finger plate 190 is hingably carried by the hand plate and provides protection for the user's fingers. Three versions of the finger plate are disclosed. As seen in FIG. 1, the finger plate may be a singular plate, or as seen in FIG. 2, a compound plate allows for separate protection of the index and outer fingers. As seen in FIG. 3, the compound plate may be angled, which may tend to protect the hand better where several fingers are involved in grasping, while the index fingers are involved in guiding a work piece.

An insulating layer 400 is carried by the bottom surface of the armor plate. A nylon glove 500 is attached to the armor plate by fastening means, such as adjustable straps.

It is therefore a primary advantage of the present invention to provide a novel apparatus for protecting a worker's hand that is strong enough to give absolute protection against circular and band saws.

Another advantage of the present invention is to provide a novel apparatus for protecting a worker's hand that allows free movement of the user's fingers, while safely protected beneath a shield of armor.

Another advantage of the present invention is to provide a novel apparatus for protecting a worker's hand that provides a plurality of hinged plates, thereby better adjusting to the movements of the worker's hand and fingers.

Another advantage of the present invention is to provide a novel apparatus for protecting a worker's hand that is adaptable to any size hand because all the joints in the armor plate are hinged.

A still further advantage of the present invention is to provide a novel apparatus for protecting a worker's hand that optionally provides a compound finger plate that better conforms to the movements of individual fingers.

DRAWINGS

These and other features, aspects, and advantages of the present invention will become better understood with regard to the following description, appended claims, and accompanying drawings where:

DESCRIPTION

Figures 1, 1A, 1B, 1C:
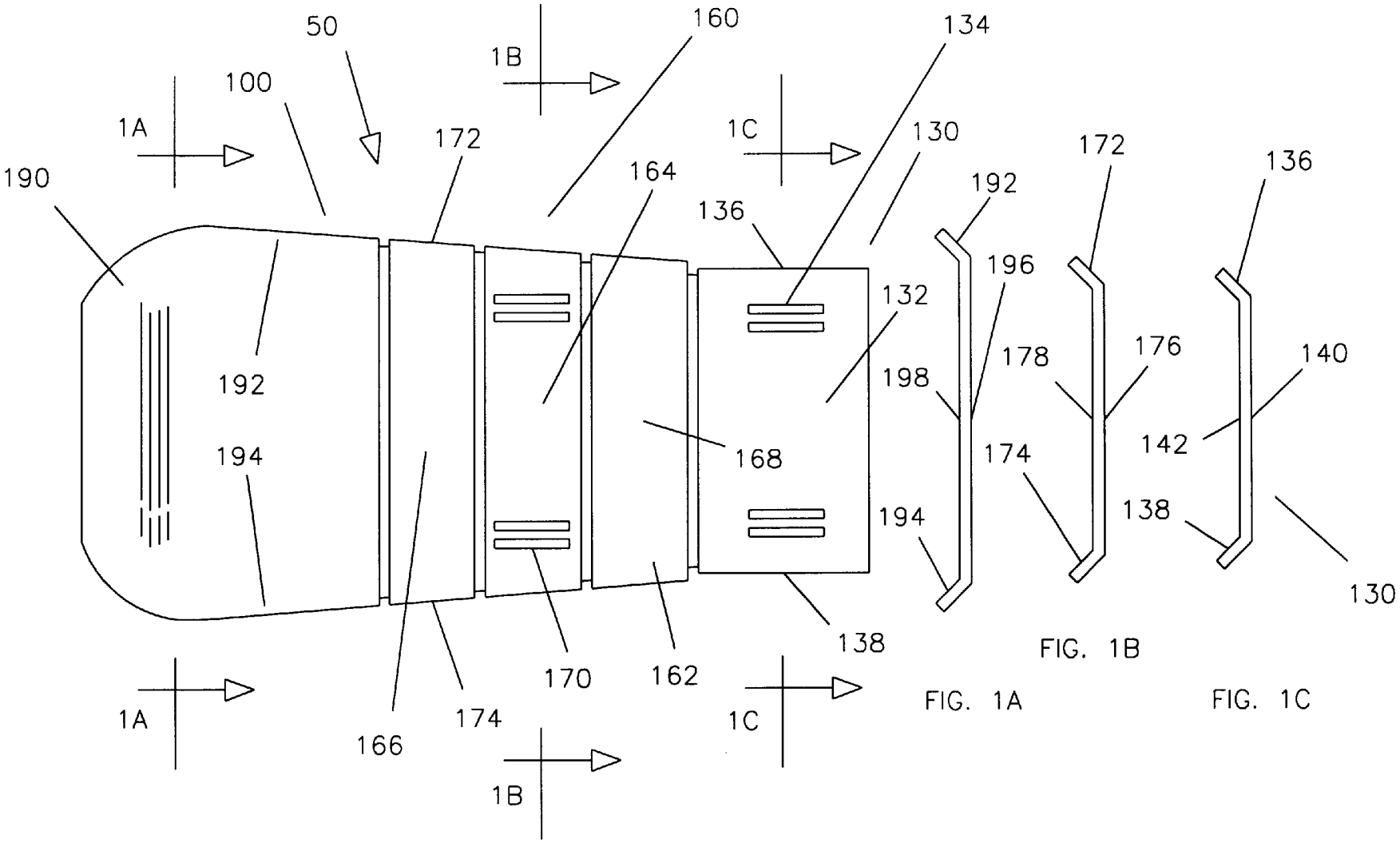
FIG. 1 is a top orthographic view of a version of the invention having a single finger plate.
FIG. 1A is a cross-sectional view of the finger plate of FIG. 1, taken between the 1A—1A lines.
FIG. 1B is a cross-sectional view of the hand plate of FIG. 1, taken between the 1B—1B lines.
FIG. 1C is a cross-sectional view of the wrist plate of FIG. 1, taken between the 1C—1C lines.

Referring in general to the figures, an apparatus 50 for protecting a worker's hand and wrist constructed in accordance with the principles of the invention is seen. The apparatus provides a generally planar armor plate 100 covering the back of the wrist, hand and fingers. An insulating layer 400 covers the lower surface of the armor plate. The armor plate is segmented into hingably related wrist 130, hand 160 and finger plates 190. A glove 500, worn by the user, is connected to the armor plate by a plurality of adjustable straps.

Referring to FIG. 1, the upper surface 102 of a first version of the armor plate 100 is seen. The armor plate provides a wrist plate 130, a segmented hand plate 160 and a finger plate 190. In the preferred version of the invention, the armor plate is formed from 18 or 20 gauge stainless steel. The armor plate may be formed for either the left or right hand, or a version suitable for either hand may be made. Typically, the version of the invention seen in FIGS. 2 and 3, having a compound finger plate, are suited for use with only the left or right hand, while the version having a unitary finger plate may be constructed to be usable with either hand.

Figure 2:
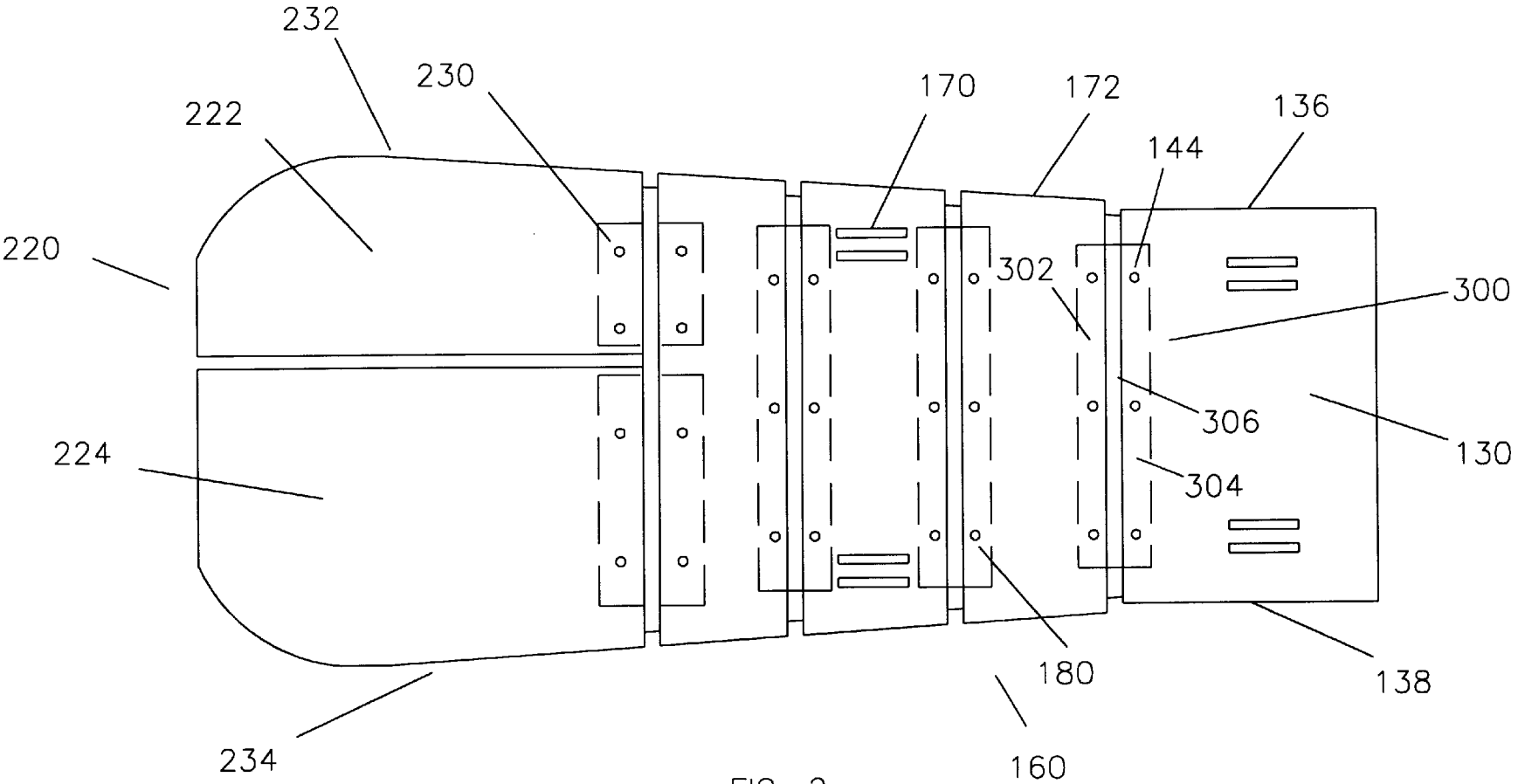
FIG. 2 is a top orthographic view of a version of the invention having a compound finger plate.
Figure 3:
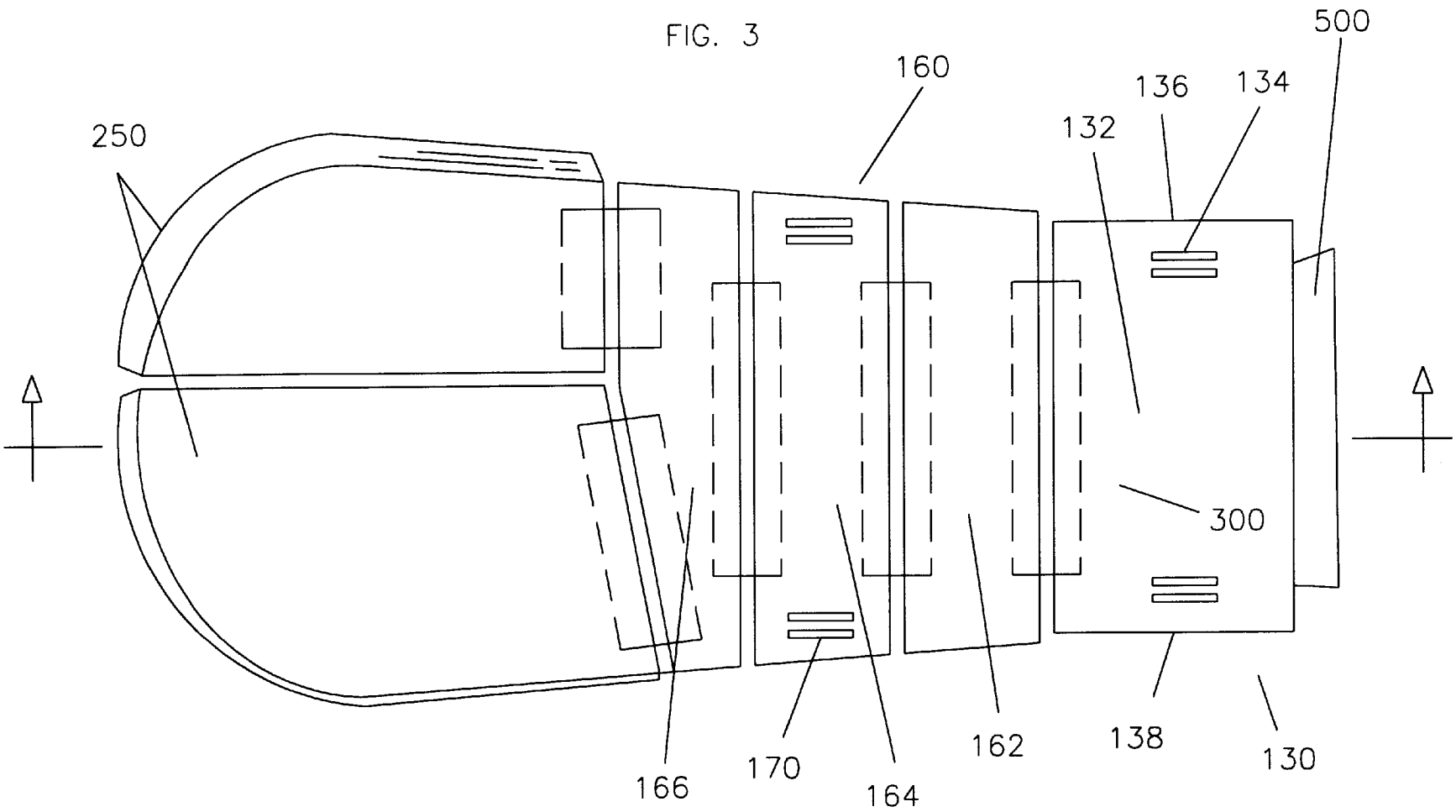
FIG. 3 is a top orthographic view of a version of the invention having a compound finger plate where the outer finger plate is supported at an angle to the hand plate.

As seen in FIGS. 1–3, a wrist plate 130 is 4.25 inches in width and 2 inches in length (in the lengthwise direction of the apparatus 50) in a preferred embodiment. The wrist plate provides an upper surface 140, which is seen in FIGS. 1–3, and a lower surface 142, which is best seen in the cross-sectional view of FIG. 4. The wrist plate provides a plate body 132 carrying an inner flange 136 and an outer flange 138. The inner and outer flanges are best seen in the cross-sectional view of FIG. 1C. The inner and outer flanges serve several purposes. First, they tend to keep the apparatus 50 centered about the user's wrist and hand. Second, they tend to protect the side of the hand and wrist to some degree. Also, the flanges tend to aid in positioning the wrist strap 600, as will be seen.

The plate body 132 defines inner and outer fastener attachment slot pairs 134 which are usable in supporting wrist strap 600. In a well-understood manner, a strap may be fed into one slot and back out the other slot, thereby frictionally engaging the plate body.

A plurality of joint fastening points 144 allow the attachment of a hinged joint 300. The hinged joint 300 pivotally connects the wrist plate 130 to the hand plate 160. Each hinged joint provides elongate forward and rear plates 302, 304 joined by a piano type hinge 306. The fastening points 144, which attach the wrist plate to the joint 300, may be formed by any type of fastener or fastening method. In a preferred embodiment, fastening points 144 are spot welds, and therefore do not require drilling, screws or other fasteners. Such a fastening method provides a smooth surface which is unlikely to snag or bind.

As seen in FIG. 1–3, in the preferred embodiment, a hand plate 160 is formed of an inner plate segment 162, a middle plate segment 164 and an outer plate segment 166. The three segments are related to each other and to the wrist plate by hingable fastening means such as hinged joints 300, of the type described above. Such a hinged joint typically allows pivoting motion over a range of approximately 300 degrees (although this is not possible when the apparatus 50 is being worn). Fastener attachment points 180 are typically spot welds.

In a preferred embodiment of the invention, the middle and inner plate segments are 1⅝" long and approximately 4¾" wide. The outer plate segment is typically 1" long and approximately 5" wide. As is seen in FIGS. 1–3, the outer plate segment is typically wider than the middle plate segment, which is wider than the inner plate segment. This causes the inner and outer flanges 172, 174, carried by the plate body 168 of each plate segment to be staggered with respect to the flanges of adjacent plate segments. This is best illustrated in FIGS. 1 through 1C, where the forward end of the apparatus 50 is seen to be generally wider than the rearward end. The staggered plate structure reduces or eliminates contact between the flanges of adjacent plate segments.

The plate segments 162, 164, 166 of the hand plate 160 each provide a plate body 168 carrying an inner flange 172 and an outer flange 174. The inner and outer flanges are best seen in the cross-sectional view of FIG. 1B. The inner and outer flanges of the hand plate tend to perform much the same functions as the flanges of the wrist plate. First, they tend to keep the apparatus 50 centered about the user's hand. Second, they tend to protect the side of the hand and wrist to some degree. Also, the flanges tend to aid in positioning the hand strap 650, as will be seen.

Figure 4:
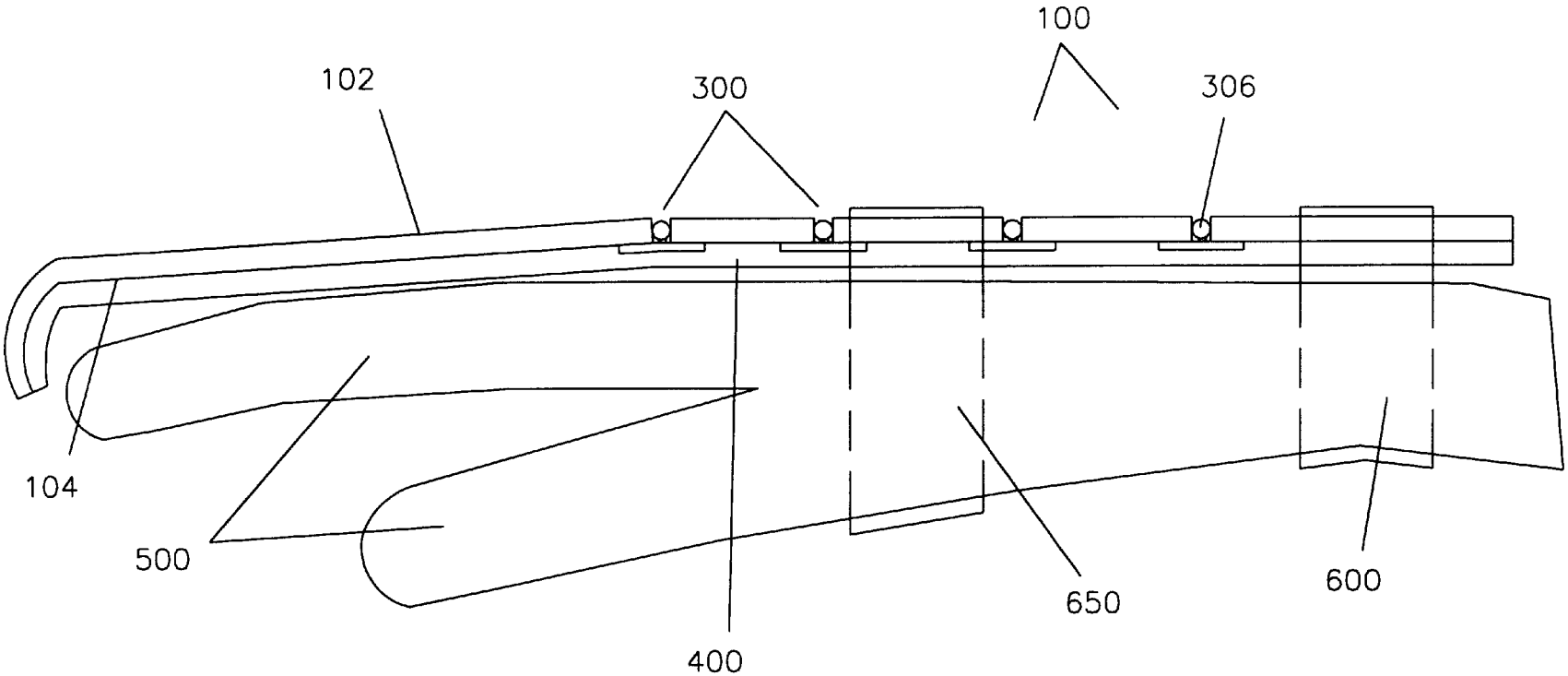
FIG. 4 is a cross-sectional view of the version of the invention of FIG. 3, showing the armor plate, the insulating layer, the glove and the fastening straps.

The plate segments each have a top surface 176, seen in FIG. 1, and a bottom surface, seen in FIG. 4 attached to the insulating layer 400.

In the preferred embodiment, the plate body of the middle plate segment defines inner and outer fastener attachment slot pairs 170 which are usable in supporting hand strap 650 in the manner described above.

Referring in particular to FIGS. 1 and 1A, a finger plate 190 is seen. The plate 190 has a top surface 196, a bottom surface 198, and supports inner and outer flanges 192, 194. Fastening points similar to fastening points 230 of the compound finger plate 220 allow the attachment of a pivoting joint 300, which is in turn connected to the hand plate 160.

Referring next to FIG. 2, a compound finger plate 220 provides an index finger plate 222 and an outer finger plate 224. Both plates 222, 224 pivot by means of a pivoting joint 300 with respect to the hand plate 160. Each plate provides a protective top surface and a bottom surface carrying an insulating layer 400. Fastening points 230 secure the pivoting joint 300 to the the plates 222, 224. Inner and outer flanges 232, 234 are similar to the flanges of the finger plate 190.

Referring to FIG. 3, an angled compound finger plate 250 is similar to the compound finger plate 220, but provides an outer finger plate that is pivotably mounted at an angle to the hand plate 160. This arrangement may be beneficial, depending on the nature of the work performed.

As seen in FIG. 4, an insulating layer 400 is carried by the lower surface 104 of the armor plate. The insulating layer is typically applied by adhesive or other fastening means and serves to promote warmth and comfort, and may also absorb some shock energy, in the event that the armor plate 100 is struck by a saw. The insulating layer may be made of any type of rubber, foam rubber or similar material, and may be compound in nature where multiple layers are desired.

Still referring to FIG. 4, the armor plate may curve somewhat, past the end of the finger tips of the glove.

As seen in FIG. 4, a glove 500 is carried below and adjacent to the insulating layer. The glove is typically made of nylon, although other materials could be used if desired. The fabric used is typically chosen so that the glove allows the user to move the entire hand with ease and full dexterity. In a cold environment, such as a meat packing plant, it may be desirable to include some insulation in the construction of the glove.

As seen in FIG. 4, a wrist strap 600 and a hand strap 650 connect the armor plate 100 and insulating layer 400 to the glove 500 when the user is wearing the glove. The use of both straps is desirable, since this keeps the apparatus 50 firmly in place about the user's hand and forearm.

The straps 600, 650 adjustably attach to the fastener attachment slots 134, 170, as described above, allowing the user to adjust the strap length as needed.

To use the apparatus for protecting a worker's hand, the worker first puts on the glove 500 and secondly puts on the armor plate 100 by using the straps 600, 650. The straps are adjusted to keep the armor plate firmly in place. The worker then proceeds with the job, typically in the meat cutting or saw mill industries, with the protective advantages apparatus.

The previously described versions of the present invention have many advantages, including a primary advantage of providing a novel apparatus for protecting a worker's hand that is strong enough to give absolute protection against circular and band saws.

Another advantage of the present invention is to provide a novel apparatus for protecting a worker's hand that allows free movement of the user's fingers, while safely protected beneath a shield of armor.

Another advantage of the present invention is to provide a novel apparatus for protecting a worker's hand that provides a plurality of hinged plates, thereby better adjusting to the movements of the worker's hand and fingers.

Another advantage of the present invention is to provide a novel apparatus for protecting a worker's hand that is adaptable to any size hand because all the joints in the armor plate are hinged.

A still further advantage of the present invention is to provide a novel apparatus for protecting a worker's hand that optionally provides a compound finger plate that better conforms to the movements of individual fingers.

Although the present invention has been described in considerable detail and with reference to certain preferred versions, other versions are possible. For example, the dimensions given above are somewhat flexible, in that the invention could be practiced in much the same manner with similar, though different, dimensions. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An apparatus for protecting a worker's hand and wrist, comprising:

(A) an armor plate, comprising:

(a) a wrist plate, comprising:

(i) a plate body, the plate body defining inner and outer fastener attachment slots;

(ii) an inner flange and an outer flange, the inner and outer flanges carried by the plate body;

(b) a hand plate, comprising:

(i) an inner plate segment, hingably attached to the wrist plate, carrying an inner and an outer flange, wherein the inner and outer flanges of the inner plate segment are staggered for non-interfering movement with respect to the inner and outer flanges of the wrist plate;

(ii) a middle plate segment having a plate body defining inner and outer fastener attachment slots and having inner and outer flanges, the middle plate segment hingably attached to the inner plate segment;

(iii) an outer plate segment, hingably attached to the middle plate segment, carrying an inner and an outer flange;

(c) a compound finger plate, comprising:

(i) an index finger plate, hingably attached to the hand plate; and (ii) an outer finger plate, hingably attached to the hand plate;

(B) an insulating layer, carried by a lower surface of the armor plate;

(C) a glove, adjacent to the insulating layer;

(D) fastening means, carried by the inner and outer fastener attachment slots of the wrist plate, for maintaining the wrist plate about the worker's wrist; and (E) fastening means, carried by the inner and outer fastener attachment slots of the middle plate segment, for maintaining the hand plate about the worker's hand.

* * * * *